United States Patent [19]

Woltron et al.

[11] Patent Number: 4,835,036

[45] Date of Patent: May 30, 1989

[54] METHOD FOR MANUFACTURING A STRING IN A FORM READY FOR A RACKET, A STRING MANUFACTURED BY SAID METHOD, AND METHOD FOR SUPPLY TO STRINGING RACKETS WITH SAID STRING

[75] Inventors: Herbert Woltron, Módling; Robert Schamesberger, Eisenstadt, both of Austria

[73] Assignee: Isosport Verbundbauteile GES.m.b.H., Eisenstadt, Austria

[21] Appl. No.: 893,307

[22] PCT Filed: Nov. 11, 1985

[86] PCT No.: PCT/AT85/00046

§ 371 Date: Jul. 8, 1986

§ 102(e) Date: Jul. 8, 1986

[87] PCT Pub. No.: WO86/02850

PCT Pub. Date: May 22, 1986

[30] Foreign Application Priority Data

Nov. 9, 1984 [AT] Austria ..... 3556/84

[51] Int. Cl.[4] ..... A63B 51/02; B65H 55/00

[52] U.S. Cl. ..... 428/192; 428/373; 428/371; 428/377; 428/394; 428/395

[58] Field of Search ..... 428/192, 373, 371, 377, 428/394, 395, 423.5, 516

*Primary Examiner*—Nancy Swisher

*Attorney, Agent, or Firm*—Bierman & Muserlian

[57] ABSTRACT

The method relates to the production of a string (24) for a racket, particularly a tennis racket. The string is a known string, for example a gut string or a synthetic string. The conditioning of the string on a support (1), particularly a bobbin, is effected under a traction tension and the length of the string is kept constant. Thus, the elongation of the string under the traction tension effect when winding the string on the support (1) is conveniently between 5 and 15%. The stringing of the racket with the thus conditioned string (24) should be carried out in an interval of 60 minutes, but preferably 30 minutes, from the removal time of the string from its support (1). The relaxation of the string, i.e. the decrease of tension after the stringing of the racket, is considerably smaller with a string conditioned according to the invention than with a same string which has not been conditioned. Such relaxation reduction is particularly important with a polypropylene string.

13 Claims, 4 Drawing Sheets

METHOD FOR MANUFACTURING A STRING IN A FORM READY FOR A RACKET, A STRING MANUFACTURED BY SAID METHOD, AND METHOD FOR SUPPLY TO STRINGING RACKETS WITH SAID STRING

TECHNICAL DOMAIN

The invention relates to a method for manufacturing a string ready for supply for stringing, particularly a tennis racquet, as well as a string obtained by said method. It furthermore relates to a method for stringing racquets with said string.

STATE OF THE ART

Strings for tennis rackets are put on the racquet frame with a specified initial tension. It is a known fact that after the string is strung on the racquet frame, the string tension decreases steadily, with said decrease in tension taking place at a rate of decrease that drops with passing time. A majority of the decrease of the string tension generally takes place within a span of approximately 40 seconds after the respective string is strung on the racquet frame.

This phenomenon is known as relaxation which holds true with different intensity for gut strings as well as for the various synthetic strings. It entails that the string must always be put on the racquet frame with an initial tension that is considerably above the average string tension in the racquet over the life of the stringing. however, the extent of the initial tension is limited in that it must lie within the elastic range. This relaxation is relatively minor in gut strings. But gut strings have other disadvantages which are brought about by quality fluctuations of the gut material used, and, on the other hand, by their high absorption of moisture, which impairs the playability of racquets with gut strings due to the great change in length this causes at high atmospheric humidity. In addition, production of gut strings is relatively expensive. In the commercially available strings made of a polyamide monofilament said relaxation is somewhat greater, but still relatively small.

However, only relatively hard stringing can be effected with such polyamide strings, bringing about some disadvantes to the player. This is explained in greater detail with the aid of the graphs shown in FIG. 1.

Figure 1:
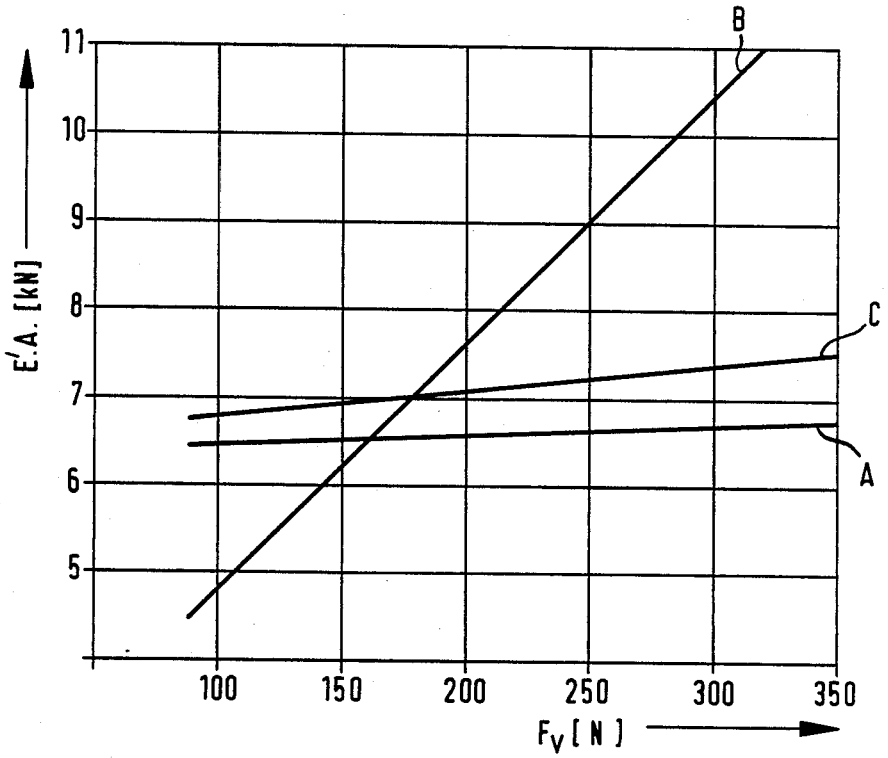

In FIG. 1, the graph for a commercial gut string shows the dependence of the spring rate E'.A (in kN), as defined by the product of the modulus of elasticity A and the sectional area A of the string, on the initial stressing force $F_v$ of the string (in N). As can be seen, the value of this spring rate changes very little with initial stressing force of the string. This shows the good playability properties of tennis racquets with gut strings.

Strings of polyamide monofilaments show spring rate characteristics of a kind as shown, e.g., by graph B in FIG. 1: in the eligible range of the string's initial stressing force $F_v$ of 200 to 300 N, the spring constant E'.A is greater than in comparable gut strings and, in addition, with increased initial tension it rises essentially linearly on a relatively steep incline. The result is that the deformations of the string occurring upon the ball impacting on the racquet are lesser than in comparable gut strings and that the force peaks required to brake a specific kinetic energy of the ball and which must be absorbed by the racquet are correspondingly higher than in gut strings.

The player therefore regards a racquet with synthetic strings as being "hard," which in comparison with racquet with gut strings feels even harder, the more forceful the shots have to be made.

The applicant has now discovered that, e.g., a string, in which monoaxially drawn film strips of polypropylene which has, e.g., a melt index MFI 190/5 determined according to DIN 53735 in a size of approximately 0.3 to 0.5 g/10 min., are welded together in several superposed layers, will have with graph A a spring rate characteristic similar to that of a gut string (see graph A). Such a string is described in the international patent application AT84/00014 (WO83/03998). However, this string exhibits relatively strong relaxation.

DESCRIPTION OF THE INVENTION

The invention has the object of disclosing a method for producing a string in a form ready for supply for stringing a racquet in which the relaxation of the string then strung on the racquet is reduced.

This problem is solved in the method according to the invention, which is characterized by that the string—for its conditioning for the stringing process—is wound under traction tension on a support where its length is kept at least substantially constant. The elongation of the string created by the traction tension during the winding on the support is advantageously at least 5%, and this elongation is preferably between 5 and 15%, respectively.

According to a preferred embodiment of the method of the invention, the string used is composed preponderantly of a drawn thermoplastic synthetic material which advantageously contains a polyolefin or is composed of a polyolefin. The polyolefin is advantageously composed at least preponderantly of polypropylene, preferably of a nucleated polypropylene.

According to another advantageous embodiment of the invention, both ends of the string are fastened to the support.

In a further advantageous embodiment of the invention, the method according to the invention is characterized by that the support used has a convex cylindrical surface, appropriately a circular cylindrical surface, onto which the string is wound in a single layer under traction tension.

According to yet another advantageous embodiment of the invention, at least one end of the string is wedged, for the purpose of its fastening, into a wedge-shaped slot arranged in the support.

The invention relates furthermore to a string in a form ready for supply for stringing a racquet, particularly for a tennis racquet, which is obtained according to the method of the invention.

Lastly, the invention has the object to disclose a method for stringing racquets, particularly tennis racquets, with the strings according to the invention, in which the properties of the string of the invention have a particular effect.

This problem is solved in the method according to the invention that is characterized in that the string or a section of the string is removed from the support and the stringing process is carried through with the aid of the string or the section of the string, respectively, within 60 minutes but preferably within 30 minutes, of its removal from the support.

In an advantageous embodiment of the invention, the method according to the invention is characterized by that the stringing of the racquet is effected with an initial tension that is within the range between 80 and 150%, but preferably between 80 and 120% of the traction tension with which the string, for the purpose of its conditioning, has been wound onto the carrier.

BRIEF DESCRIPTION OF THE DRAWING RELEVANT TO THE INVENTION IN CONNECTION WITH A WAY TO CARRY OUT THE INVENTION

The invention is explained in detail below with the aid of FIGS. 2 through 5.

Figure 3:
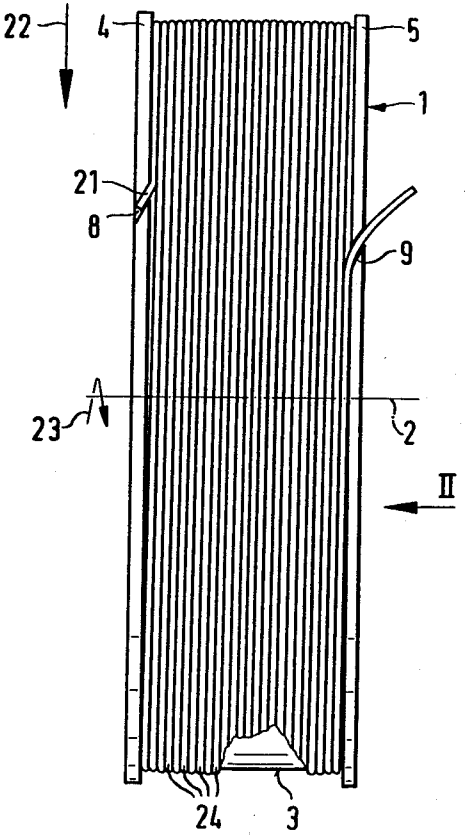
Figure 2:
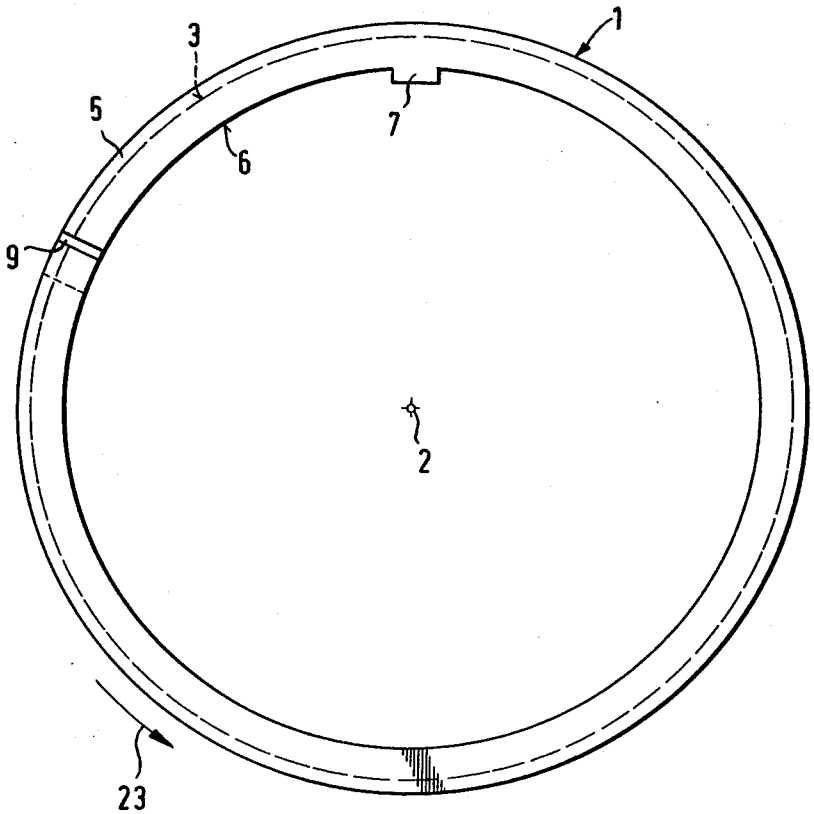

A coil-shaped support 1 is shown in FIG. 2 in partial view, perpendicular to the coil axis 2 in vertical section, and in FIG. 3 in a sectional view parallel to the coil axis. This support has a convex circular-cylindrical surface 3 which at both ends is defined by coil walls 4, 5 and at whose circular-cylindrical inside surface of support 1 a lug 7 is arranged. In addition, wedge-shaped slots 8, 9 are provided at both coil walls 4, 5 for attaching the ends of the string to be wound on the support 1.

Figure 4:
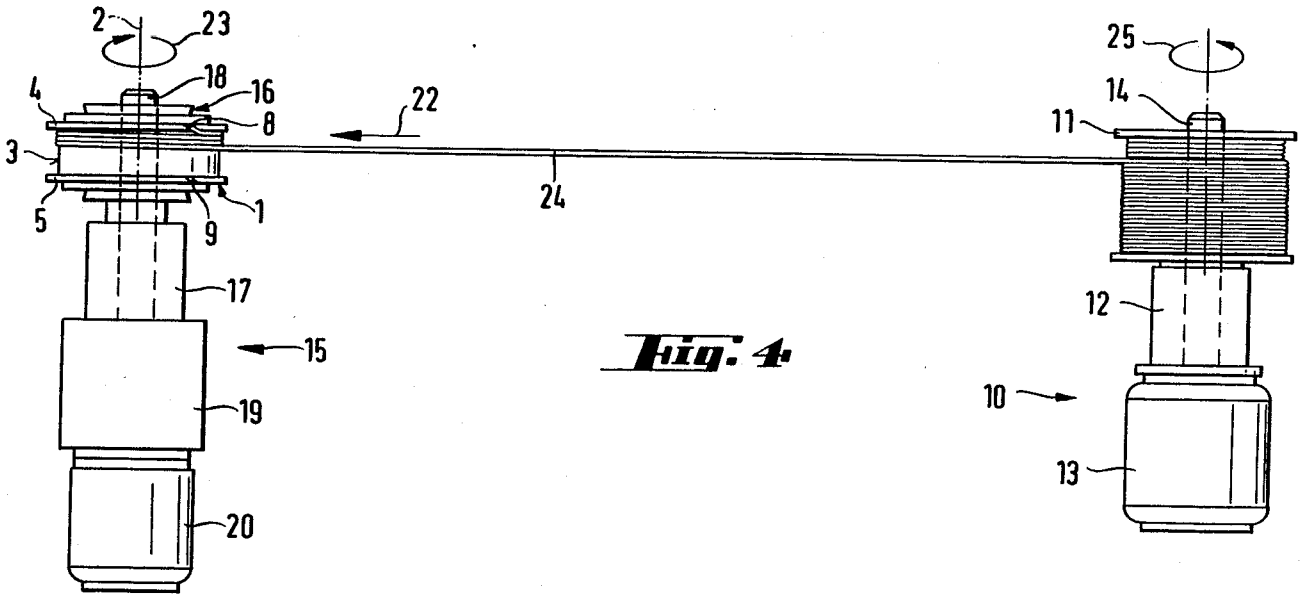

FIG. 4 shows in diagrammatic representation a device for working the method according to the invention. It is comprised of a take-off station 10, in which a string magazine in the form of a coil 11 is arranged on a shaft 14 that is pivoted at 12 and is connected to a motor brake 13. The device consists further of a take-up station 15 with a seat in the shape of a clamping cone 16 for the support 1, the lug 7 of which engages a groove at the clamping cone (not shown in the figure). This clamping cone 16 sits on a shaft 18 pivoted at 17, which can be driven by a motor 20 by way of a reduction gear 19.

For working the method according to the invention, e.g., a commercial, approximately 1.3 mm thick gut string intended for tennis racquets is used. This string is wound in considerable length. (e.g., 500 m) on the coil 11 and the latter is arranged on the shaft 14. At the same time, an empty support 1 is clamped on the clamping cone 16 of take-up station 15. The free end 21 of the string is then pulled off the coil 11 in the direction of arrow 22 and pressed into slot 8 of the support 1 (see FIG. 1). The motor 20 and the motor brake 13 are then switched on, whereby the support is turned in the direction of arrow 23 (i.e., counterclockwise in FIG. 2) and the string 24 is taken off coil 11 overcoming a preset torque imparted by the motor brake 13 on the coil 11 and acting in the direction of arrow 25. The torque of the motor brake is adjusted in such a manner that the winding up of the string 24 on the support 1 is effected at a traction tension of 275 N, at which the string 24 experiences an elongation of about 6% over its original length. Winding of the string 24 on the support 1 is effected in a single layer with closely adjoining windings until the surface 3 has a full winding. Motor 20 is thereupon switched off and string 24 is pushed into the wedge-shaped slot 9 at the end of the windings, whereupon motor brake 13 is switched off, the string 24 is then cut outside the coil 11 so that only a string-end, about 1 to 2 cm long, will project, and the support on which the gut string 24 has been wound is removed from the clamping cone 16. The gut string 24 thusly wound onto the support 1 with traction tension is now conditioned in the form as to be supplied according to the invention.

Figure 5:
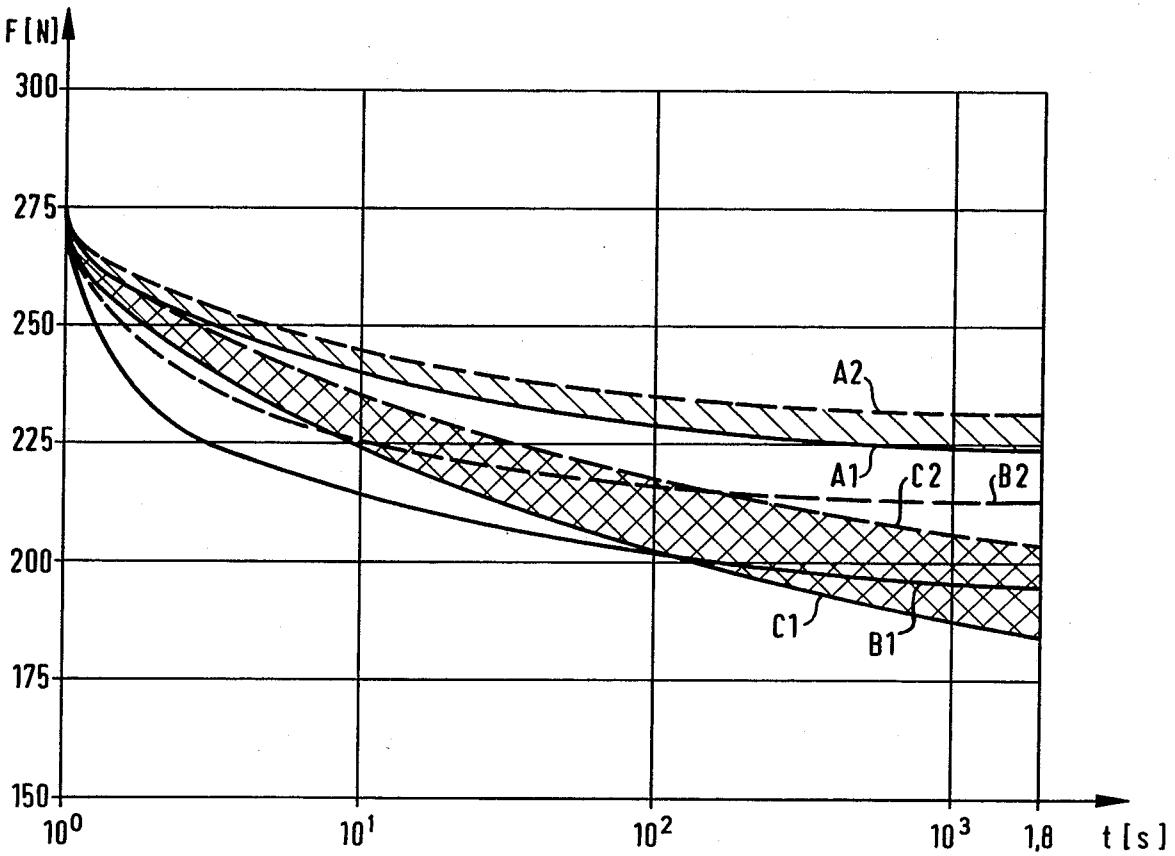

As has been set forth at the beginning of the specification, a decrease of the string tension takes place after stringing of the string onto the racquet frame, due to relaxation of the string material. In order to evaluate this effect by means of measurements, the relaxation of the string is determined with the aid of a simple testing arrangement. For this, the string piece to be tested is fastened at one end over a capsule-type dynamometer and then very quickly stretched to a traction tension of 275 N. The other end of the string is then also fastened and subsequently the decrease of the traction tension obtaining in the string is observed or recorded as a function of time. In FIG. 5 this function is shown in graph A1 in semilogarithmic representation. As can be seen, when the string's traction tension decreases from the value of 275 N to about 226 N within 30 minutes ($1.8.10^3$ s).

When a gut string is used to string a tennis racquet, such as is made available for stringing in the conditioned form according to the invention as described with the aid of FIGS. 2 and 3, one finds that the relaxation occurring in the string strung on the racquet is considerably smaller than with a string that has not been conditioned. This reduction of the relaxation is then the stronger, the shorter the time during which the string is strung on the racquet after its removal from the support.

This behavior is confirmed by the results of the relaxation measurement which is then effected on the gut string shortly after its removal from the support. This relaxation—expressed by the decrease of the string traction tension F as a function of time, according to graph A2 in FIG. 5—shows that this decrease is markedly smaller than with a gut string that has not been conditioned.

The graph B1 in FIG. 5 shows the relaxation of a commercial, 1.3 mm thick string of a polyamide monofilament, and graph B2 shows the relaxation of the same string when it was supplied in the conditioned form according to the invention and the piece of string used to determine the relaxation was taken from the support a short time before that. The decrease of relaxation as compared to the relaxation determined on the string that had not been conditioned is thus already quite considerable here.

The graph C1 shows the relaxation as determined on a 1.3 mm string, in which—as described in the international patent application PCT AT83/00014—monoaxially drawn film strips of a polypropylene that have a melt index MFI 190/S=0.3 g/10 min as determined according to DIN 53735 are welded together in several superposed winding layers. Graph C2 shows the relaxation of the same string as made available in the conditioned form according to the invention. In this case, too, a considerable reduction of the relaxation is obtained, which is even more significant with this string material, since this string, when strung on the racquet without having been conditioned, exhibits a relatively strong relaxation, as shown by graph C1.

The traction tension expended in producing the conditioned string according to the invention by winding the string onto the support is to create in the string an elongation that advantageously should be at least 5%, but preferably in the range between 5 and 10%. This traction tension need in no way be always equal as great as the initial stressing force then provided for stringing the racquet, but should be of approximately the same order. In particular, the stringing of the racquet is usually effected with an initial tension that lies within 80 and 150%, but preferably between 80 and 120% of the traction tension with which it was conditioned.

A good effect is obtained for stringing a tennis racquet with a string supplied in the conditioned form according to the invention—especially with synthetic strings—, when the stringing process is effected with the aid of the string or string section, respectively, within 60 minutes of its removal from the support. Better results are obtained, when the stringing operation is carried out within 30 minutes.

COMMERCIAL UTILIZATION

With the aid of the method of the invention for the production of a string in a form ready for supply for stringing racquets, particularly tennis racquets, per se known strings are conditioned in such a manner that the respective relaxation of the string strung on the racquet becomes smaller than that of the same string in an unconditioned state. The usability of the strings is enhanced by this conditioning.

We claim:

1. A method of manufacturing a string in a form ready for supply to a racquet, particularly a tennis racquet, wherein the string, for conditioning it for the stringing operation, is wound under traction tension, the amount of elongation being sufficient for at least 5% elongation of the string, onto the convex surface of a coil support and its length is kept there at least substantially constant.

2. The method of claim 1 wherein the string elongation is between 5 and 15%.

3. The method of claim 1 wherein the string is at least predominantly a drawn thermoplastic synthetic material.

4. The method of claim 3 wherein the synthetic material or is a polyolefin.

5. The method of claim 4 wherein the synthetic material is at least predominantly polypropylene.

6. The method of claim 5 wherein the polypropylene is a nucleated polyolefin.

7. The method of claim 1 wherein both ends of the string are fastened to the support.

8. The method of claim 1 wherein the string is wound in a single layer under traction tension on the convex surface.

9. A string prepared by the method of claim 1.

10. A string of claim 9 wherein at least one end of the string is wedged into a wedge-shaped slot arranged in the support to secure the same.

11. A method of stringing racquets, particularly tennis racquets, with a string held on a support ready for supply wherein the string of claim 9 is used and wherein the stringing is completed within 60 minutes of the removal of the string from the support.

12. The method of claim 11 wherein the stringing is completed within 30 minutes of the strings removal from the support.

13. The method of claim 11 wherein the stringing of the racquet is effected with an initial tension of 80 to 150% of the traction tension with which the string was wound on the support.

* * * * *

UNITED STATES PATENT AND TRADEMARK OFFICE

CERTIFICATE OF CORRECTION

PATENT NO. : 4,835,036

DATED : May 30, 1989

INVENTOR(S) : HERBERT WOLTRON

It is certified that error appears in the above-identified patent and that said Letters Patent is hereby corrected as shown below:

Claim 1, line 5, cancel "elongation" and insert
--this tension--

Signed and Sealed this

Twenty-sixth Day of June, 1990

*Attest:*

HARRY F. MANBECK, JR.

*Attesting Officer*

*Commissioner of Patents and Trademarks*